US006847280B2

(12) United States Patent
Kung

(10) Patent No.: US 6,847,280 B2
(45) Date of Patent: Jan. 25, 2005

(54) SHIELDED INDUCTORS

(75) Inventor: Samuel Kung, Fullerton, CA (US)

(73) Assignee: BI Technologies Corporation, Fullerton, CA (US)

( * ) Notice: Subject to any disclaimer, the term of this patent is extended or adjusted under 35 U.S.C. 154(b) by 0 days.

(21) Appl. No.: 10/163,259

(22) Filed: Jun. 4, 2002

(65) Prior Publication Data

US 2003/0222749 A1 Dec. 4, 2003

(51) Int. Cl.[7] ..... H01F 27/02
(52) U.S. Cl. ..... 336/83; 336/212; 336/221
(58) Field of Search ..... 336/212, 83, 221, 336/192, 65, 180, 90, 84 R; 29/603.23, 602.1, 606

(56) References Cited

U.S. PATENT DOCUMENTS 3,371,301 A * 2/1968 Hisano
3,577,109 A * 5/1971 Foster et al. ..... 336/84 R
4,459,576 A * 7/1984 Fox et al. ..... 336/84 C
4,725,804 A * 2/1988 Yarpezeshkan ..... 336/5
5,070,317 A * 12/1991 Bhagat ..... 336/200
5,111,174 A * 5/1992 Kriz ..... 336/73
5,559,487 A * 9/1996 Butcher et al. ..... 336/178
5,684,445 A * 11/1997 Kobayashi et al. ..... 336/83
5,717,552 A * 2/1998 Varian ..... 360/125
5,814,986 A 9/1998 Goskowicz et al.
5,912,609 A * 6/1999 Usui et al. ..... 336/83
6,522,233 B1 * 2/2003 Kyoso et al. ..... 336/200
6,617,948 B2 * 9/2003 Kuroshima et al. ..... 336/83

* cited by examiner

*Primary Examiner*—Anh Mai
(74) *Attorney, Agent, or Firm*—Eric K. Satermo

(57) ABSTRACT

An inductor includes a core, a coil disposed about the core, and a shield. The shield and the core are connected to each other so that a closed magnetic loop is formed. The core may be a single piece or made up of a pair of core segments. The shield may include two halves or portions or may include a cover with a base. The core may be unitary with the shield at one or both ends thereof. In embodiments where the shield includes two portions, the portions may have substantially identical geometry and dimensions.

44 Claims, 4 Drawing Sheets

SHIELDED INDUCTORS

BACKGROUND OF THE INVENTION

1. Field of the Invention

The present invention relates to electrical components, specifically inductors.

2. Description of the Related Art

The desirability for electrical components that are smaller in size but that have better electrical properties never fades. Often there are trade offs when it comes to designing such components. For example, when size is reduced, one or more of the electrical properties is adversely affected.

In the case of inductors, electromagnetic interference (EMI) is one of the properties that is desirably minimized or eliminated. EMI is an unwanted electromagnetic signal which may degrade the performance of an electronic device. To reduce EMI effects caused by inductors, shields are placed about the inductor. Shielded inductors thereby require more space than unshielded types. In addition, the shields require grounding.

BRIEF SUMMARY OF THE INVENTION

An inductor includes a core, a coil disposed about the core, and a shield. The shield and the core are connected to each other so that a closed magnetic loop is formed. The core may be a single piece or made up of a pair of core segments. The shield may include two halves or portions or may include a cover with a base. The core may be unitary with the shield at one or both ends thereof. In embodiments where the shield includes two portions, the portions may have substantially identical geometry and dimensions.

For a given energy storage capability, the inductor of the invention greatly improves upon conventional inductors. For example, the inductor of the invention is able to store the same amount of energy at a volume of about 10 times less than conventional toroidal inductors. In addition, with ratio of width to length of the inductor of the invention may be on the order of 1 to 1, while such ratio for conventional toroidal inductors is on the order of 2 to 1.

Other features and advantages of the present invention will become apparent to those skilled in the art from a consideration of the following detailed description taken in conjunction with the accompanying drawings.

DETAILED DESCRIPTION OF THE INVENTION

Figure 1:
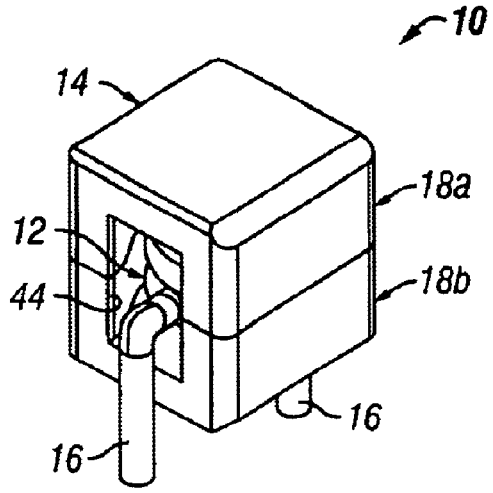
FIG. 1 is a perspective view of a shielded inductor.
Figure 2:
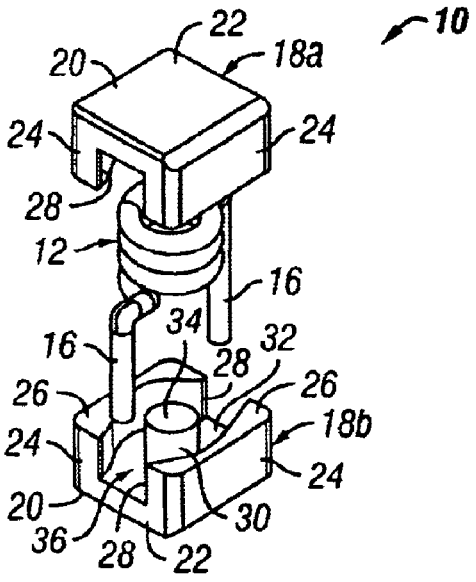
FIG. 2 is an exploded perspective view of a shielded inductor.

Referring to FIGS. 1 and 2 in detail, an inductor 10 includes a coil 12 and a shielded core 14. The coil 12 may have a pair of terminals 16, and the shielded core 14 may include a first portion 18*a* and a second portion 18*b*.

Figure 3:
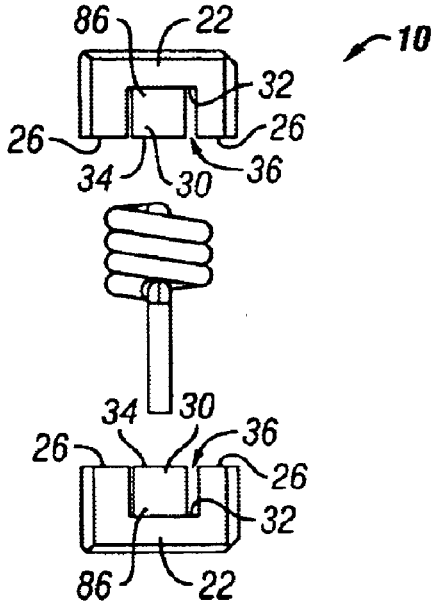
FIG. 3 is an exploded side view of a shielded inductor.

As shown in FIG. 2, each portion 18 may include a housing 20 having an end wall 22 and a side wall 24. In the embodiment shown, the side wall 24 of each housing 20 may have a mating edge 26, which is also shown in FIG. 3. In addition, a pair of notches 28 may be formed in the side wall 24 for receiving a terminal 16 of the coil 12.

The housing of each portion 18 of the core 14 may also include a core segment 30, which is shown clearly in FIG. 3. The core segment 30 may be disposed on an inner surface 32 of the end wall 22. Each core segment 30 may have an end face 34. In a number of embodiments, a seat 36 may be defined within each portion 18, for example, the between the side wall 24 and the core segment 30 for receiving the coil 12.

Figure 4:
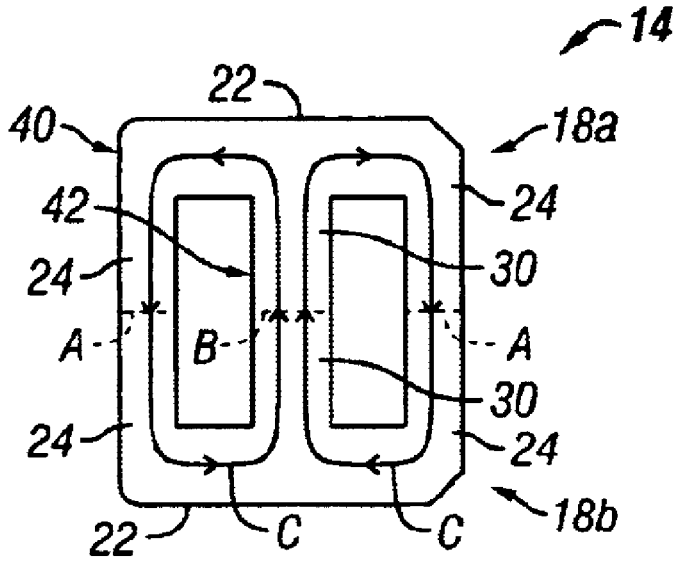
FIG. 4 illustrates a closed magnetic loop of a shield and a core of an inductor.

With additional reference to FIG. 4, when the first and second portions 18*a* and 18*b* are engaged together with the coil 12 received by the seats 36, the mating edges 26 of the side walls 24 of the housings 20 mate with each other as shown by the dashed lines indicated at A to form a magnetically continuous shield 40. In addition, the end faces 34 of the core segments 30 contact each other as shown by the dashed line indicated at B to form a magnetically continuous core 42. Accordingly, a closed magnetic loop is formed by the shield 40 and the core 42, as indicated by magnetic flux lines C. When mounted in an electric circuit, the shield 40 does not require grounding.

As shown in FIG. 1, when the portions 18 are engaged, the notches 28 of the housing 20 of the first portion 18*a* respectively align with the notches 28 of the housing 20 of the second portion 18*b* to form a pair of apertures 44 in the shield 40 (only one of the apertures is shown in FIG. 1). Accordingly, with the coil 12 received by the seats 36 about the core 42, the terminals 16 may respectively project through the apertures 44 of the shield 40.

Figure 5:
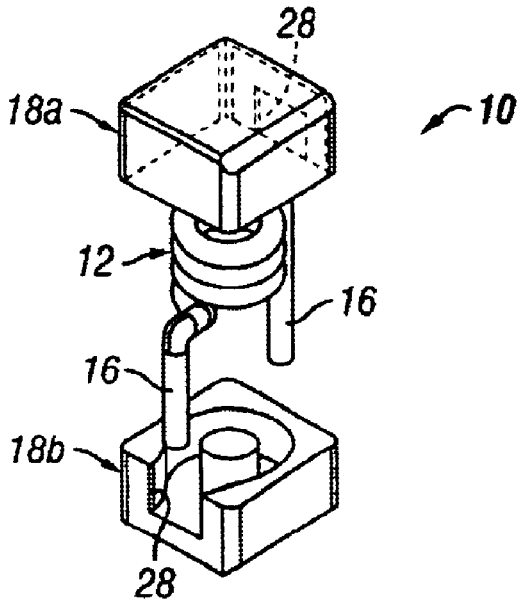
FIG. 5 is an exploded perspective view of a shielded inductor.
Figure 6A:
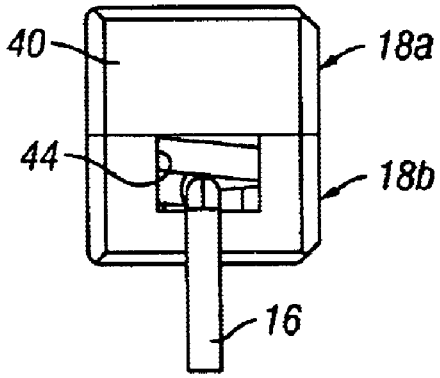
FIGS. 6A and 6B are side views of the inductor of FIG. 5.
Figure 6B:
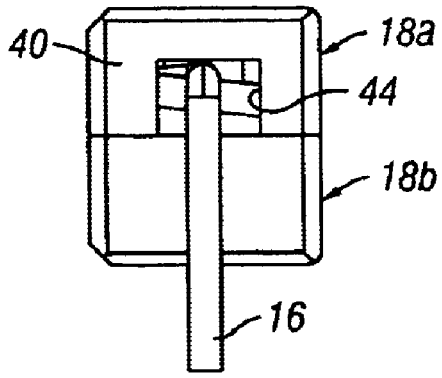

In a number of embodiments, for example, as shown in FIG. 5, a single notch 28 may be formed in the side wall 24 of each portion 18. Accordingly, when the portions 18 are secured as shown in FIGS. 6A and 6B, a pair of apertures 44 are formed in the shield 40 for respectively receiving the terminals 16 of the coil 12.

Figure 7:
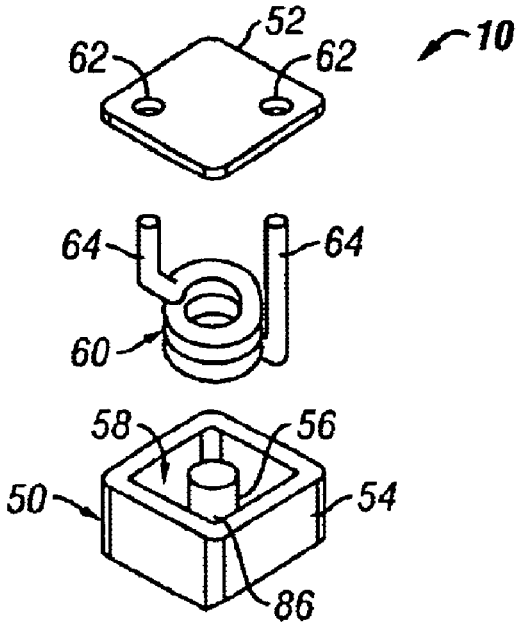
FIG. 7 is an exploded perspective view of a shielded inductor.
Figure 7A:
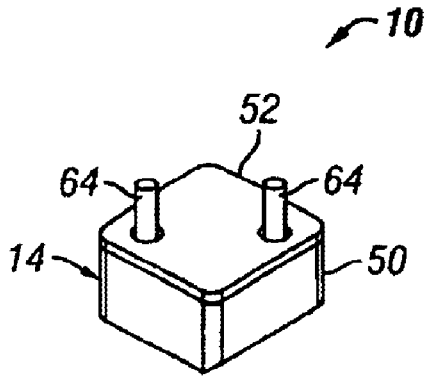
FIG. 7A is a perspective view of the inductor of FIG. 7.

In other embodiments such as those shown in FIG. 7, the shielded core 14 may include a first portion such as a base 50 and a second portion such as cover 52. The base 50 may include a side wall 54 and a core 56, with a seat 58 for receiving a coil 60 defined between the side wall 54 and the core 56. The cover 52 may include a pair of apertures 64 for respectively receiving terminals 64 of the coil 60 when the coil is received in the seat 58. When the cover 52 is mated with the base 50 and the core 56 as shown in FIG. 7A, a closed magnetic loop is formed by the base 50, the cover 52, and the core 56, with the terminals 64 projecting through the apertures 64.

Figure 8:
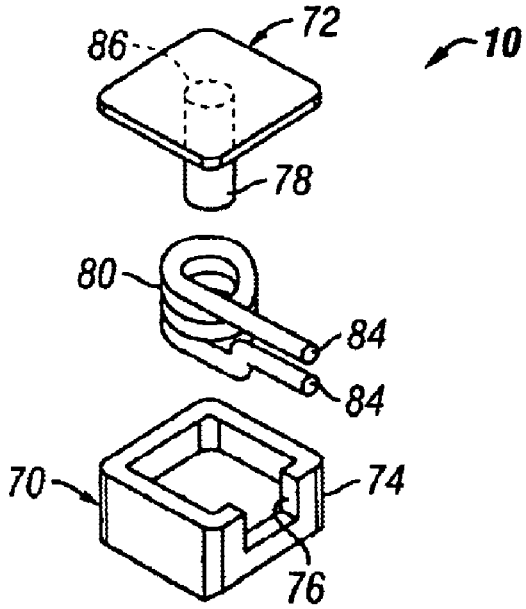
FIG. 8 is an exploded perspective view of a shielded inductor.
Figure 8A:
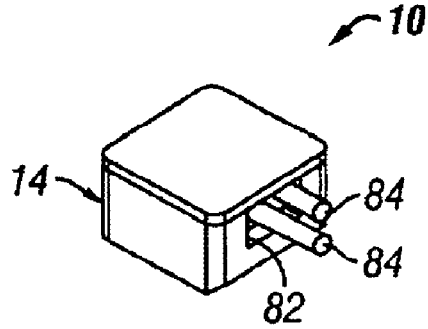
FIG. 8A is a perspective view of the inductor of FIG. 8.

In still other embodiments, a single aperture may be utilized. For example, as shown in FIG. 8, the shielded core 14 may include a first portion such as a base 70 and a second portion such as cover 72. The base 70 may include a side wall 74 with a notch 76 formed therein. A core 78 is provided and may be disposed on either the base 70 or the cover 72; in the embodiment shown, the core 78 is attached to the cover 72. When the cover 72 is mated with the base 70 with a coil 80 received about the core 78 as shown in FIG. 8A, an aperture 82 is formed, and a closed magnetic loop is formed by the base 70, the cover 72, and the core 78, with terminals 84 of the coil 80 projecting through the aperture 82.

Figure 9:
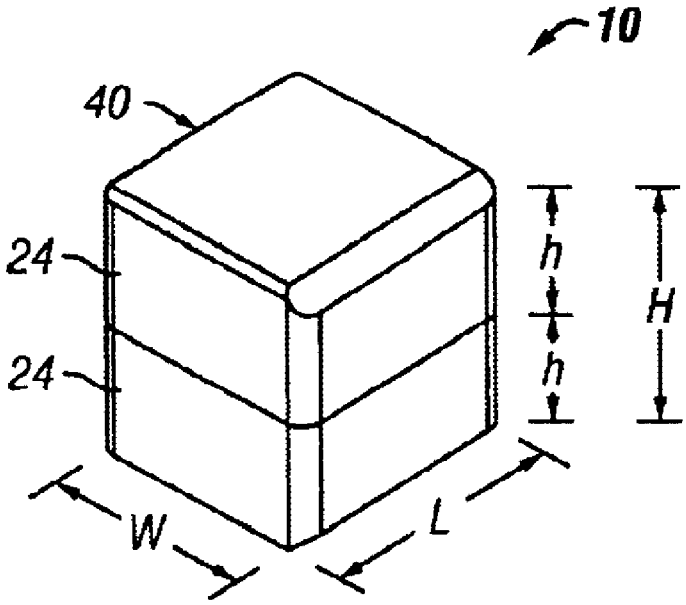
FIG. 9 illustrates dimensions of a shielded inductor.

In a number of embodiments, the dimensions of the inductor 10 are minimized while still maintaining desirable electrical characteristics. As an example, with reference to FIG. 9, an overall height H of the shield core 40 may be less than about 10 mm, with the side wall 24 of each housing having a height h of less than about 5 mm. In addition, the shielded core 40 may have a length L of less than about 10 mm and a width W of less than about 10 mm. Accordingly, in embodiments where the dimensions are approximately equal, a ratio of width W to length L is on the order of 1 to 1. In other embodiments, the width-to-length ratio is less than about 1.5 to 1.

As another example, one of the electrical properties for inductors is energy storage, which is a determined by the equation $E=\frac{1}{2}LI^2$, where L is inductance and I is current DC. A desirable characteristic of inductors is volume versus energy storage. If each of the dimensions (i.e., height H, length L, and width L) of the inductor 10 is about 6.8 mm, then a volume of the shield core 40 is about 310 $mm^3$. At these dimensions, the inductor 10 may have an inductance of about 400 nH (nanohenrys) at a frequency of about 100 kHz and a current of about 20 amperes DC, and an energy storage of 80 $\mu$J (microjoules). For comparison purposes, a conventional toroidal inductor capable of storing the same amount of energy would need to have a length of about 20 mm, a width of about 20 mm, and a height of about 8 mm, thereby having a volume of about 3,200 $mm^3$. Accordingly, the inductor 10 with a columnar core 42 and closed magnetic loop of the present invention reduces the volume by over 10 times for the same energy storage capability.

In a number of embodiments, such as that shown in FIGS. 1, 2, and 3, the first and second portions 18*a* and 18*b* of the shielded core 14 have substantially identical geometry and substantially equal dimensions. Accordingly, during manufacturing, only a single die, mold, or cast (depending upon the manufacturing process) needs to be made to produce the portions 18 of the shielded core 14 with, e.g. powder iron, thereby reducing costs. In addition, the core segment 30 and the housing 20, specifically, the end wall 22, of each portion 18 may be of unitary construction, thereby eliminating manufacturing processes dedicated to producing a separate core and attaching such core to a shield. In other words, an end 86 (see FIGS. 3, 7, and 8) of the core 78 or core segment 30 may be unitary with the shield 14.

With regard to manufacturing, to fabricate t inductor 10, the coil 12 may be positioned in the seat 36 of the housing 20 of one of the portions 18 with the terminals aligned with the notch or notches 28. The other portion may then be positioned thereon, with the mating edges 26 and the end faces 34 respectively contacting. The portions 18*a* and 18*b* may be secured together at the mating edges 26 of the side walls 24 with, for example, adhesive such as epoxy. Although the coil 12 may be wound about the core, the coil 12 may be prefabricated, e.g., with an automatic winder, to reduce manufacturing costs.

Those skilled in the art will understand that the preceding exemplary embodiments of the present invention provide the foundation for numerous alternatives and modifications thereto. These other modifications are also within the scope of the present invention. Accordingly, the present invention is not limited to that precisely as shown and described in the present invention.

What is claimed is:

1. An inductor comprising:

a coil including a pair of terminals; and a shielded core including a first portion and second portion;

each of the portions including:

a housing having an end wall and a side wall, the side wall having a mating edge and a pair of notches;

a core segment disposed on an inner surface of the end wall and having an end face; and a seat defined between the housing d the core segment for receiving the coil;

wherein when the first and second portions e engaged together with the coil received by the seats:

the mating edges of the side walls of the housings mate with each other to form a magnetically continuous shield;

the end faces of the core segments contact each other to form a magnetically continuous core, such that a closed magnetic loop is formed by the shield and the core;

the notches of the housing of the first portion respectively align with the notches of the housing of the second portion to form a pair of aperatures in the shield; and the coil is received by the seats about the core with the terminals respectively projecting through the apertures of the shield.

2. An inductor as claimed in claim 1 wherein the side wall of each of the housings has a height of less than about 5 mm, such that a height of the shield is less than about 10 mm.

3. An inductor as claimed in claim 2 wherein the shield has a length of less than about 8 mm and a width of less than about 8mm.

4. An inductor as claimed in claim 3 wherein the inductor has an inductance of about 400 nH at a frequency of about 100 kHz.

5. An inductor as claimed in claim 1 wherein the first and second portions of the shielded core have substantially identical geometry.

6. An inductor as claimed in claim 1 wherein the core segment and the housing of each portion are of unitary construction.

7. An inductor as claimed in claim 1 wherein the mating edges are secured together with adhesive.

8. An inductor comprising:

a core;

a coil disposed about the core;

a shield connected to core to form a closed magnetic loop.

9. An inductor claimed in claim 8 wherein the core has a pair of ends that are unitary with the shield.

10. An inductor as claimed in claim 8 wherein the core includes at least one core segment that is unitary with the shield.

11. An inductor comprising a core, a coil disposed about the core, and a shield connected to core to form a closed magnetic loop;

wherein the core includes two core segments and the shield includes two housings;

the core segments being unitary with the housings, respectively.

12. An inductor claimed in claim 11 wherein each of the core segments has an end face and each of the housings has a mating edge;

the end faces contacting each other and the mating edges contacting each other when the housings are engaged to form the shield.

13. An inductor claimed in claim 11 wherein the housings have substantially identical geometry.

14. An inductor claimed in claim 11 wherein the housings have substantially identical dimensions.

15. An inductor claimed in claim 11 wherein each of the housings has a pair of notches;

the notches of one of the housings aligning with the notches of the other housing when the housings are secured together to form a pair of apertures through which terminals of the coil are receivable.

16. An inductor comprising a core, a coil disposed about the core, and a shield connected to core to form a closed magnetic loop;

wherein the core has a pair of terminals, the shield including a pair of apertures through which the terminals are receivable.

17. An inductor comprising a core, a coil disposed about the core, and a shield connected to core to form a closed magnetic loop;

wherein the shield has a height of less than about 10 mm, a length of less than about 8 mm, and a width of less than about 8 mm.

18. A method of manufacturing inductor, the method comprising:

providing a plurality of housings each including:

an end wall and a side wall with a mating edge and a pair of notches;

a core segment disposed on an inner surface of the end wall and having an end face; and a seat defined between the housing and the core segment;

positioning a coil with a pair of terminals in the seat of one of the housings with the terminals positioned at the notches; and securing another one of the housings to the housing with the coil such that the mating edges of the side walls and the end faces of the core segments are respectively in magnetic contact, thereby forming a closed magnetic loop.

19. A method as claimed in claim 18 wherein the core segment and the end wall of each housing are unitary.

20. A method as claimed in claim 18 wherein the housings have substantially identical geometry.

21. An inductor comprising a core, a coil disposed about the core, and a shield connected to core to form a closed magnetic loop:

wherein the shield includes a first portion an a second portion each having at least one notch;

when the first and second portions are connected together, the notch of the first portion aligns with the notch of the second portion to form aperture.

22. An inductor claimed in claim 21 wherein the coil has at least one terminal for projecting through the aperature.

23. An inductor comprising:

a core;

a coil disposed about the core; and a shield including a first portion and a second portion each having a notch;

when the first and second portions are connected together for enclosing the core and the coil, the notch of the first portion aligns with the notch of the second portion to form an aperture.

24. An inductor claimed in claim 23 wherein each of the portions includes a pair of notches;

whereby when the first and second portions are connected together, the notches of the first portion respectively align with the notches of e second portion to form a pair of apertures.

25. An inductor claimed in claim 24 wherein the coil includes a pair of terminals for respectively projecting through the apertures.

26. An inductor as claimed in claim 23 wherein the first and second portions contact the core when connected together to form a closed magnetic loop.

27. An inductor claimed in claim 23 wherein the first and second portions have substantially identical geometry.

28. An inductor claimed in claim 23 wherein the core includes a pair of core segments connected to the first and second portions, respectively.

29. An inductor claimed in claim 28 wherein the core segments connect together to form a magnetically continuous core when the first and second portions are connected together.

30. An inductor claimed in claim 28 wherein each of the portions includes an end wall to which one of the core segments is connected.

31. An inductor claimed in claim 28 wherein each of the portions and the respective one of the core segments are of unitary construction.

32. An inductor claimed in claim 23 wherein the first and second portions are secured together with adhesive.

33. An inductor claimed in claim 23 wherein the shield has a height of less than about 10 mm.

34. An inductor claimed in claim 33 wherein the shield has a length of less than about 8 mm and a width of less than about 8 mm.

35. An inductor claimed in claim 34 wherein the inductor has an inductance of about 400 nH at a frequency of about 100 kHz.

36. A shield for inductor with a coil, the shield comprising:

a first portion and a second portion each having a notch;

the notches aligning with each other to form aperture when the portions are engaged together to enclose the coil.

37. A shield as claimed in claim 36 wherein each of the portions have a pair of notches which respectively align with each other to form a pair of apertures.

38. A shield as claimed in claim 36 wherein the coil has a pair of terminals;

the apertures respectively receiving the terminals of the coil.

39. A shield as claimed in claim 36 further comprising a core;

the core and the shield forming a closed magnetic loop when the portions are engaged.

40. A shield as claimed in claim 36 wherein each of the portions includes a core segment;

the core segments contact each other to form a magnetically continuous core when the portions are engaged.

41. A shield as claimed in claim 40 wherein the core segments and the first and second portions are of unitary construction.

42. A shield as claimed in claim 40 wherein the first and second portions have substantially identical geometry.

43. A method of manufacturing an inductor, the method comprising:

providing a core;

providing a shield including a first portion and a second portion each having at least one notch;

disposing a coil about the core; and connecting the first and second portions together with the core and the coil therebetween such that the notches align with each other to form aperture.

44. A method of manufacturing an inductor, the method comprising:

providing a coil including a pair of terminals;

providing a pair of shield portions each including a core segment and a pair of notches;

connecting the shield portions together with the coil disposed about the core segments such that the notches of the shield portions respectively align with other to form a pair of apertures through which the terminals respectively project.

* * * * *

US006847280C1

(12) EX PARTE REEXAMINATION CERTIFICATE (6079th)

United States Patent

Kung

(10) Number: US 6,847,280 C1

(45) Certificate Issued: Jan. 1, 2008

(54) SHIELDED INDUCTORS

(75) Inventor: Samuel Kung, Fullerton, CA (US)

(73) Assignee: BI Technologies Corporation, Fullerton, CA (US)

Reexamination Request:
No. 90/007,807, Nov. 18, 2005

Reexamination Certificate for:

| | |
|---|---|
| Patent No.: | **6,847,280** |
| Issued: | **Jan. 25, 2005** |
| Appl. No.: | **10/163,259** |
| Filed: | **Jun. 4, 2002** |

(51) Int. Cl.

| | |
|---|---|
| ***H01F 27/29*** | (2006.01) |
| ***H01F 17/04*** | (2006.01) |

(52) U.S. Cl. ..... 336/83; 336/212; 336/221

(58) Field of Classification Search ..... None
See application file for complete search history.

(56) References Cited

U.S. PATENT DOCUMENTS

| | | | | |
|---|---|---|---|---|
| 4,553,123 | A * | 11/1985 | Tamada et al. | 336/83 |
| 5,760,669 | A * | 6/1998 | Dangler et al. | 336/65 |
| 2002/0017971 | A1 * | 2/2002 | Koyama et al. | 336/83 |

FOREIGN PATENT DOCUMENTS

JP 09283351 A * 10/1997

* cited by examiner

*Primary Examiner*—Erik Kielin

(57) ABSTRACT

An inductor includes a core, a coil disposed about the core, and a shield. The shield and the core are connected to each other so that a closed magnetic loop is formed. The core may be a single piece or made up of a pair of core segments. The shield may include two halves or portions or may include a cover with a base. The core may be unitary with the shield at one or both ends thereof. In embodiments where the shield includes two portions, the portions may have substantially identical geometry and dimensions.

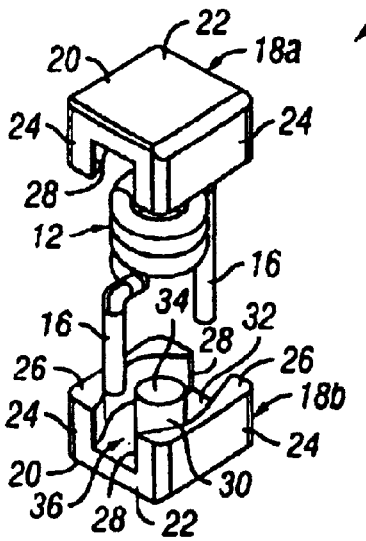

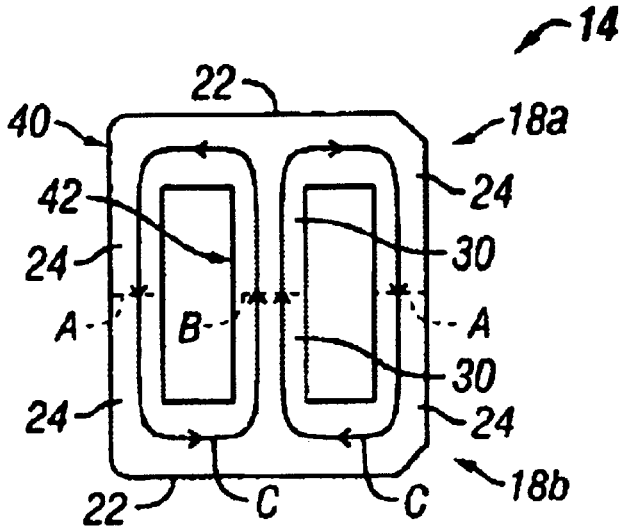

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–44 are cancelled.

* * * * *